US009706609B2

(12) United States Patent
Leonhardt et al.

(10) Patent No.: US 9,706,609 B2
(45) Date of Patent: Jul. 11, 2017

(54) LARGE AREA HIGH-UNIFORMITY UV SOURCE WITH MANY SMALL EMITTERS

(71) Applicant: Heraeus Noblelight America LLC, Gaithersburg, MD (US)

(72) Inventors: Darrin Leonhardt, Gaithersburg, MD (US); Pradyumna Kumar Swain, North Potomac, MD (US)

(73) Assignee: Heraeus Noblelight America LLC, Gaithersburg, MD (US)

( * ) Notice: Subject to any disclaimer, the term of this patent is extended or adjusted under 35 U.S.C. 154(b) by 0 days.

(21) Appl. No.: 14/478,319

(22) Filed: Sep. 5, 2014

(65) Prior Publication Data

US 2015/0069272 A1 Mar. 12, 2015

Related U.S. Application Data

(60) Provisional application No. 61/876,373, filed on Sep. 11, 2013.

(51) Int. Cl.

| | |
|---|---|
| ***H05B 33/08*** | (2006.01) |
| ***F21K 9/00*** | (2016.01) |
| *F21Y 105/12* | (2016.01) |

(52) U.S. Cl.

CPC ..... *H05B 33/0803* (2013.01); *F21K 9/00* (2013.01); *F21Y 2105/12* (2016.08)

(58) Field of Classification Search

CPC .. G21K 5/00; G21K 5/02; G21K 5/04; G21K 5/06; F21V 7/00; F21V 29/00; G03B 27/32; H05B 33/0803

See application file for complete search history.

(56) References Cited

U.S. PATENT DOCUMENTS

| | | | |
|---|---|---|---|
| 7,355,328 | B2 | 4/2008 | Botzer et al. |
| 7,355,358 | B2 | 4/2008 | Bliley et al. |
| 7,901,102 | B2 * | 3/2011 | Jung ..... G02F 1/133603 349/61 |
| 7,939,794 | B2 | 5/2011 | Rains et al. |
| 7,969,097 | B2 | 6/2011 | Van De Ven |
| 8,390,193 | B2 | 3/2013 | Li et al. |
| 8,403,531 | B2 | 3/2013 | Negley et al. |

(Continued)

OTHER PUBLICATIONS

International Search Report for PCT/US14/54331 mailed Dec. 12, 2014.

(Continued)

*Primary Examiner* — David E Smith

(74) *Attorney, Agent, or Firm* — Stradley Ronon Stevens & Young LLP

(57) ABSTRACT

A light-emitting source for curing applications is disclosed. The light-emitting source comprises a first housing having a top wall and one or more side walls. The top wall and the one or more side walls define a first enclosure having a first open end. The light-emitting source further comprises a plurality of light-emitting devices arranged within the first enclosure of the first housing. One side of each of the plurality of light-emitting devices faces outward from the first open end of the first enclosure. The plurality of light-emitting devices is configured to emit light from the first open end to produce a substantially uniform area of illumination on a facing portion of a surface of a target.

20 Claims, 6 Drawing Sheets

(56) References Cited

U.S. PATENT DOCUMENTS

| | | | | |
|---|---|---|---|---|
| 8,455,849 | B2 * | 6/2013 | Baluja | G02B 5/208 118/723 R |
| 2007/0278974 | A1 | 12/2007 | Van de Ven | |
| 2008/0226272 | A1 * | 9/2008 | Kasai | H01L 21/2686 392/418 |
| 2009/0002669 | A1 * | 1/2009 | Liu | G03F 7/70391 355/67 |
| 2009/0161356 | A1 | 6/2009 | Negley et al. | |
| 2009/0284166 | A1 * | 11/2009 | DeVincentis | H01J 65/044 315/248 |
| 2010/0164346 | A1 | 7/2010 | Li et al. | |
| 2010/0213854 | A1 | 8/2010 | Rains et al. | |
| 2012/0086324 | A1 * | 4/2012 | Voronov | H01J 61/30 313/113 |
| 2012/0086334 | A1 | 4/2012 | Devincentis et al. | |
| 2012/0188759 | A1 | 7/2012 | Sato et al. | |
| 2013/0010460 | A1 * | 1/2013 | Peil | F21K 9/00 362/217.14 |
| 2013/0070035 | A1 * | 3/2013 | Yang | B41J 11/002 347/102 |
| 2013/0201690 | A1 * | 8/2013 | Vissenberg | E04B 9/0464 362/296.07 |
| 2014/0265831 | A1 * | 9/2014 | Harbourne | H01J 65/042 315/34 |
| 2014/0306603 | A1 * | 10/2014 | Bachman | H01J 65/044 315/35 |

OTHER PUBLICATIONS

Supplementary European Search Report for European Patent Application No. EP 14 84 4275, dated Jan. 27, 2017.

* cited by examiner

LARGE AREA HIGH-UNIFORMITY UV SOURCE WITH MANY SMALL EMITTERS

CROSS-REFERENCE TO RELATED APPLICATIONS

This application claims the benefit of U.S. provisional patent application No. 61/876,373 filed Sep. 11, 2013, the disclosure of which is incorporated herein by reference in its entirety.

TECHNICAL FIELD

The invention related to an ultraviolet light-emitting source for UV curing, and more particularly, to an array of small UV emitters to provide a nearly constant irradiance of light over a large area.

BACKGROUND

In certain curing applications, such as semiconductor processing of films, flat panel display fabrication, and wide-web applications, fairly large (e.g., 10 in long) elongated UV emitting lamps have been employed to irradiate the surface of a large-area substrate (e.g., a semiconductor wafer). The resulting irradiance pattern over an irradiated substrate is generally non-uniform. Related art irradiating optical systems have employed complicated optical designs to correct non-uniform irradiance. This has resulted low efficiency (or entendue) of the radiating optical system as additional optical components are added to the system to improve the non-uniform irradiance.

SUMMARY

The above-described problems are addressed and a technical solution is achieved in the art by providing a light-emitting source for curing applications. The light-emitting source comprises a first housing having a top wall and one or more side walls. The top wall and the one or more side walls define a first enclosure having a first open end. The light-emitting source further comprises a plurality of light-emitting devices arranged within the first enclosure of the first housing. One side of each of the plurality of light-emitting devices faces outward from the first open end of the first enclosure. The plurality of light-emitting devices is configured to emit light from the first open end to produce a substantially uniform area of illumination on a facing portion of a surface of a target.

BRIEF DESCRIPTION OF THE DRAWINGS

The present disclosure will be more readily understood from the detailed description of examples presented below considered in conjunction with the attached drawings, of which.

It is to be understood that the attached drawings are for purposes of illustrating the concepts of the disclosure and may not be to scale.

DETAILED DESCRIPTION

Figure 1:
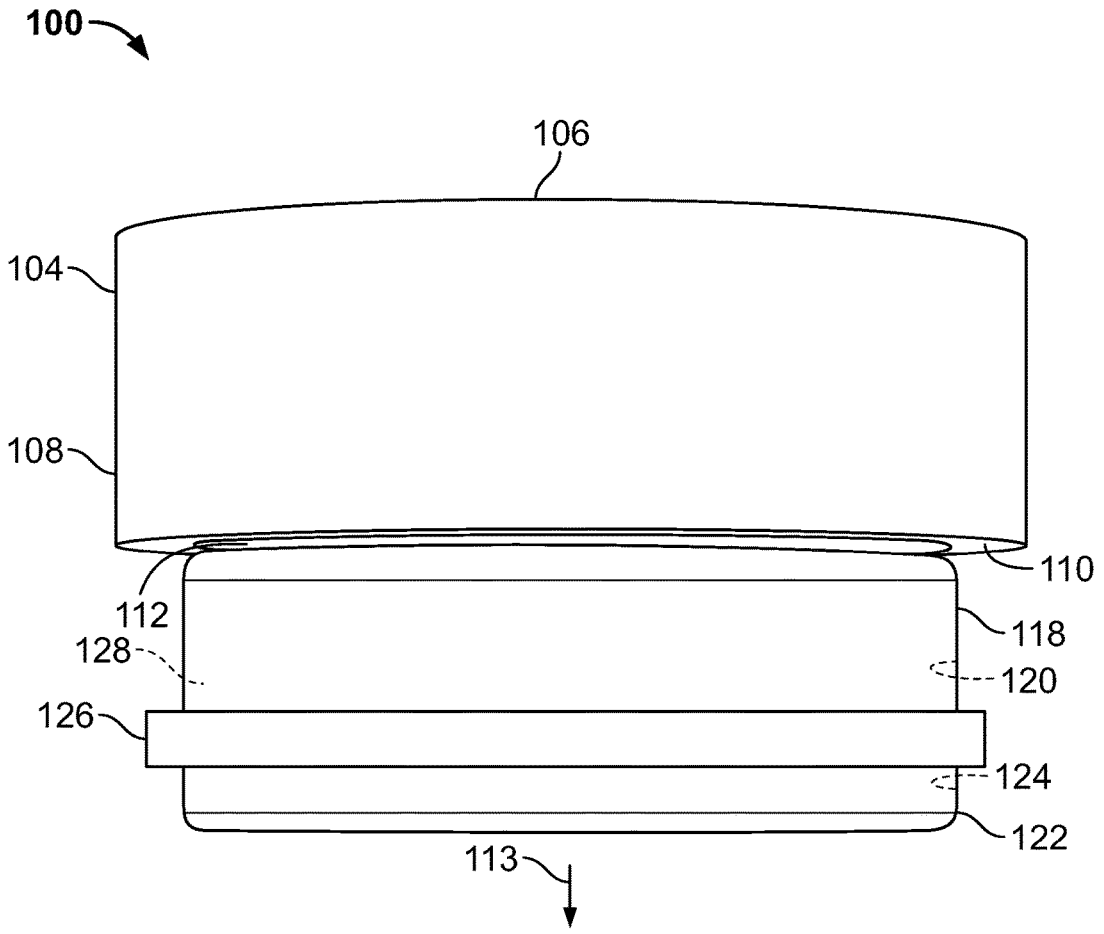
FIG. 1 shows a side view of one example of a large area irradiance apparatus of the present disclosure.
Figure 2A:
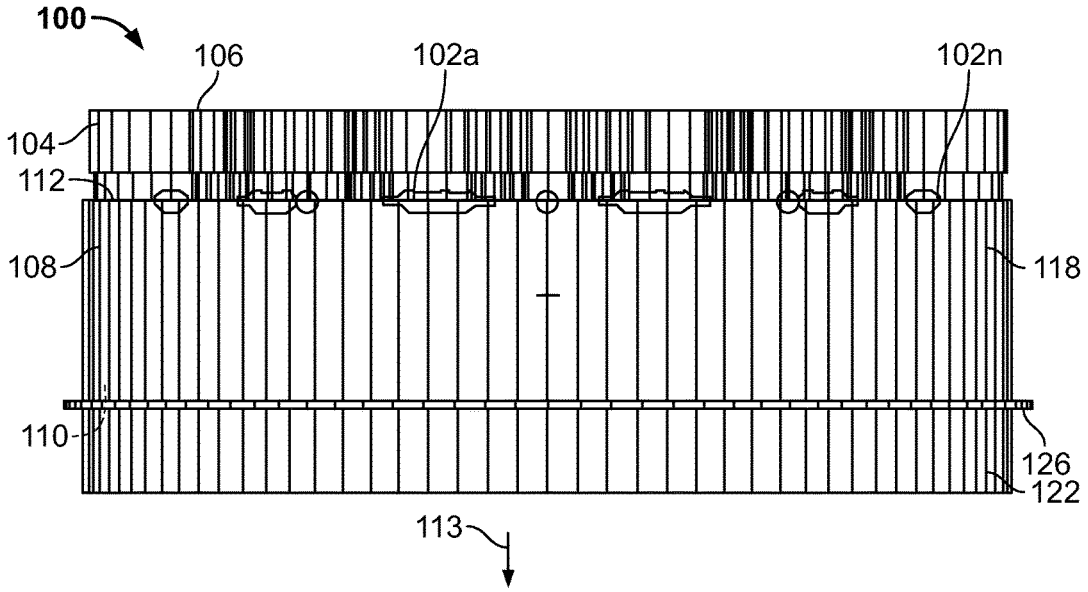
FIG. 2A shows a transparent side view of the apparatus of FIG. 1 with emphasis on the locations of an array of light-emitting devices within the apparatus.
Figure 2B:
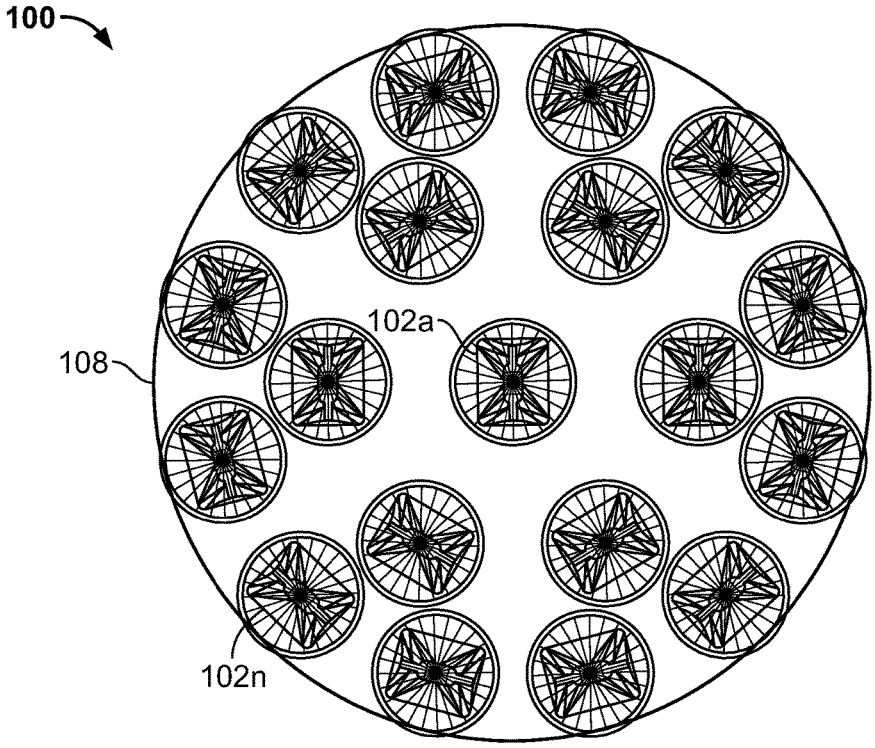
FIG. 2B shows a bottom-up view of one example of a layout pattern of the light-emitting devices within the apparatus of FIGS. 1 and 2A.

FIG. 1 shows a side view of one example of a large area irradiance apparatus 100 of the present disclosure. FIG. 2A shows a transparent side view of the apparatus 100 of FIG. 1 with emphasis on the locations of an array of light-emitting devices 102*a*-102*n* within the apparatus 100. FIG. 2B shows a bottom-up view of one example of a layout pattern of the light-emitting devices 102*a*-102*n* within the apparatus 100 of FIGS. 1 and 2A. In an example, the apparatus 100 includes an array of small (e.g., 1" long) ultraviolet light-emitting devices 102*a*-102*n*, a housing 104 having a top wall 106 and one or more side walls 108. In one non-limiting example, the housing 104 may have cylindrical shape. In the example, the top wall 106 may have a circular shape and the one or more sidewalls 108 may be one side wall forming an open cylinder (hereinafter "the sidewall 108").

The top wall 106 and the side wall 108 define an enclosure 110 having an open end 112. A plurality of light-emitting devices 102*a*-102*n* is arranged within the enclosure 110 of the housing 104. One side 116*a*-116*n* of each of the plurality of light-emitting devices 102*a*-102*n* faces outward (e.g., out of the page of FIG. 2) from the open end 112 of the enclosure 110. The plurality of light-emitting devices 102*a*-102*n* is configured to emit light from the open end 112 in the direction 113 to produce a substantially uniform area of illumination on a facing portion of a surface of a target (not shown).

Figure 3:
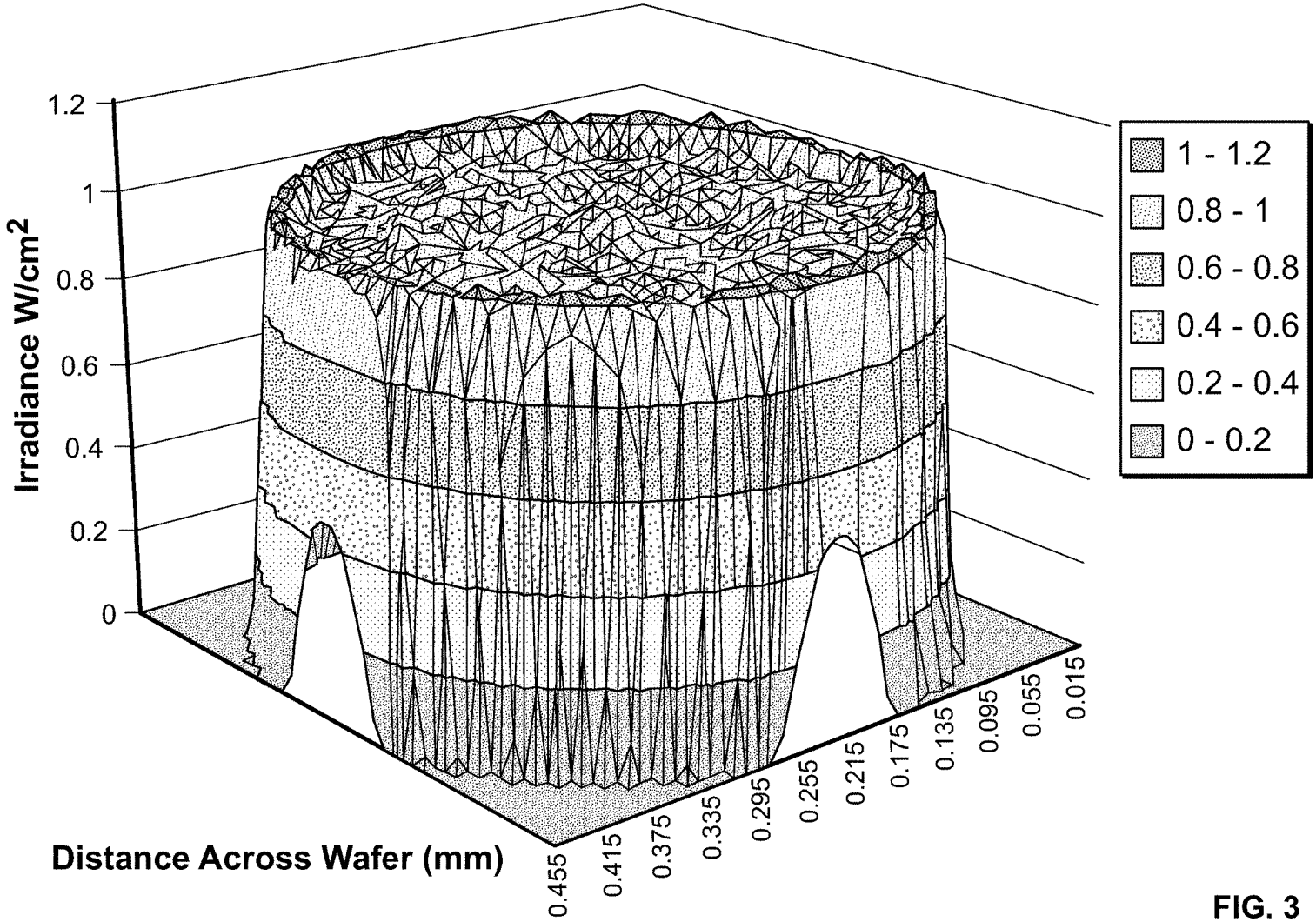
FIG. 3 shows a three-dimensional graph illustrating a simulated model of one example of optical output of the apparatus of FIGS. 1, 2A and 2B.

FIG. 3 shows a three-dimensional graph illustrating a simulated model of one example of optical output of the apparatus of FIGS. 1, 2A and 2B. The Model graph of irradiance output shows highly uniform pattern with intensity of 1 W/cm$^2$ over a 450 mm diameter. Individual emitter radiant output was set to 120 W (no specular dependence) for each of 19 emitters used in the simulation. Variation in uniformity of illumination on the facing portion of a target surface area (not shown) is less than or equal to 5% and the optical efficiency is greater than 90%. The primary contribution to the observed non-uniformity of the irradiance pattern may be attributed to the limited number photons used in the model. In a real system, superior uniformity is expected.

Returning to FIGS. 1, 2A and 2B, the location of an individual light-emitting device (e.g., 102*a*) relative to other light-emitting devices (102*b*-102*n*) of the plurality of light-emitting devices 102*a*-102*n* may be varied (e.g., is flexible) within the apparatus 100. In one example, the location of an individual light-emitting device (102*a*) may be independent (e.g., randomly arranged) of the location of other light-emitting devices (e.g., 102*a*-102*n*) of the plurality of light-emitting devices within the apparatus 100. In another example, the plurality of light-emitting devices 102*a*-102*n* may be arranged within the housing 104 with a higher density of the light-emitting devices 102*a*-102*n* proximal to the side wall 108 of the housing 104 relative to the center of the housing 104. In another example, the plurality of light-emitting devices 102*a*-102*n* may be arranged in a plane substantially parallel to the top wall 106 of the housing 104.

In an example, the apparatus may further comprise a first reflector 118 extending from the side wall 108 proximal to the open end 112 of the housing 104. In an example, the first reflector 118 may have a reflective coating on an inner surface 120 to light incident on the inner surface 120. In an example, the first reflector 118 may be made of metal or a quartz-based material. In an example, the first reflector 118 may be formed from a sheet of reflective aluminum-based material (e.g., Alanod Miro) formed in a cylindrical shape to capture and re-direct all the emissions of the light-emitting devices 102*a*-102*n* onto a substrate. The quartz-based material may have a high specular reflection dielectric coating or a diffuse quartz reflecting coating, or both.

In an example, the apparatus may further comprise a second reflector 122 extending from the first reflector 118 and, in an example, may be of (but not necessarily) the same shape (e.g., cylindrical) and/or material as the first reflector 118. In an example, the second reflector 122 may have a reflective coating on an inner surface 124 for light incident on the inner surface 124. In an example, the second reflector 122 may be made of metal or a quartz-based material. In an example, if vacuum compatibility and low contamination is required, the second reflector 122 can be made from quartz material that has a high specular reflection dielectric coating or a diffuse quartz reflecting coating such as Heraeus Reflective Coating (HRC). HRC is a ground up quartz material that is fused into the surface of quartz. HRC is manufactured by Heraeus Quartz America, LLC of Buford, Ga. Lengths, diameters and materials of the first reflector 118 and the second reflector 122 can be varied independently to optimize an irradiance profile incident on a target and to optimize manufacturing process compatibility.

In an example, the second reflector 122 may be separated from the first reflector 118 by a vacuum interface window 126. In an example, the vacuum interface window 126 may comprise quartz. The vacuum interface window 126 may further comprise an anti-reflective coating on at least one surface. A metal screen (not shown) may be located proximal to the vacuum interface window 126 for electro-magnetic interference reduction at the target, to reduce any electro-magnetic fields in the vicinity of a sensitive substrate. In an example, the first reflector 118 and the second reflector 124 may have lengths, diameters, and materials that are configured to be varied independently to optimize an irradiance profile on the surface of a target. In an example, the vacuum interface window 126, the first reflector 118, and the housing 104 may form a second enclosure 128. In an example, the second enclosure 128 may be evacuated of air to form a vacuum enclosure.

In the example bottom-view of the apparatus 100 of FIGS. 1, 2A, and 2B, in an example, the first reflector 118 and the second reflector 122 may have the same 50 cm diameter and may be made from the same highly specular material. In an example, the first reflector 118 may have a height of about 108 mm and the second reflector 122 may have a height of about 45 mm. In the example shown, the thickness of the vacuum interface window 126 may be over 1 cm.

Figure 4B:
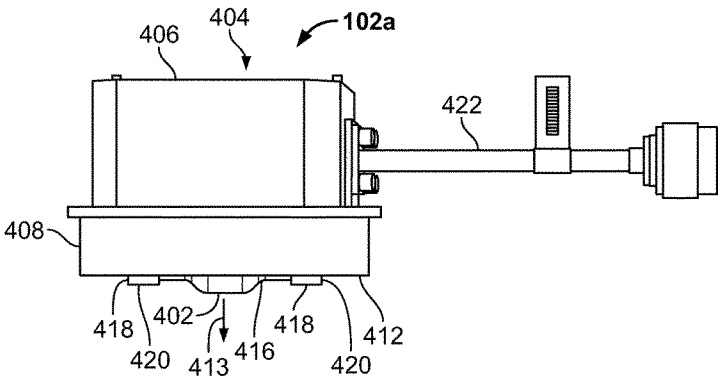
FIG. 4B is a side view of the light-emitting devices of FIG. 4A.
Figure 4A:
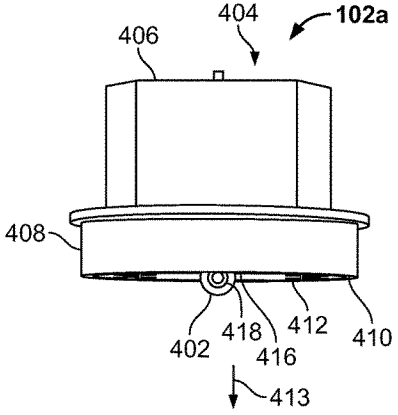
FIG. 4A is a head-on front view of an individual the light-emitting devices incorporated into the apparatus of FIG. 1.
Figure 4C:
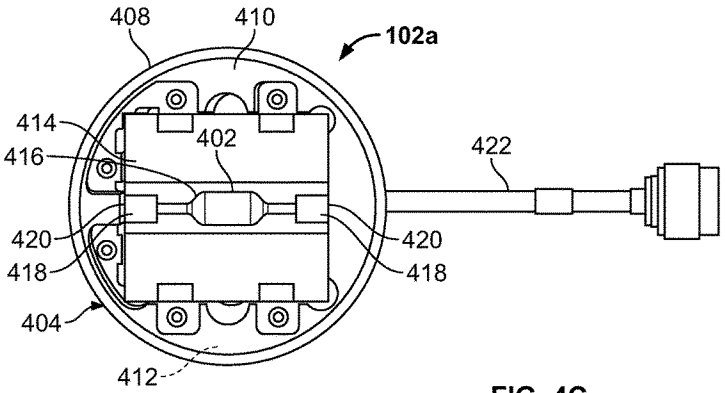
FIG. 4C is a bottom side-view of the light-emitting devices of FIG. 4B.
Figure 5A:
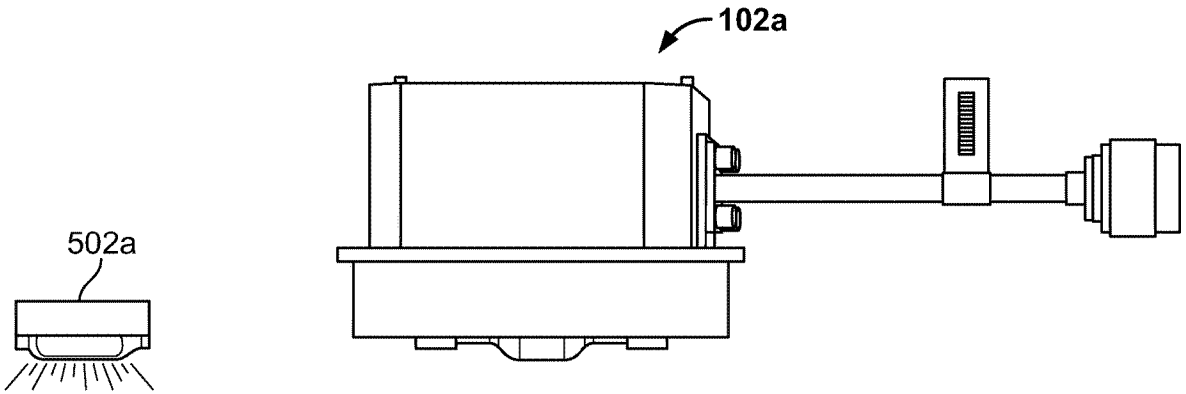
FIGS. 5A and 5B show the same views of the light-emitting devices of FIGS. 4B and 4C, respectively, with accompanying images, respectively, showing plasma emission (through welding glass) of the light-emitting devices.
Figure 5B:
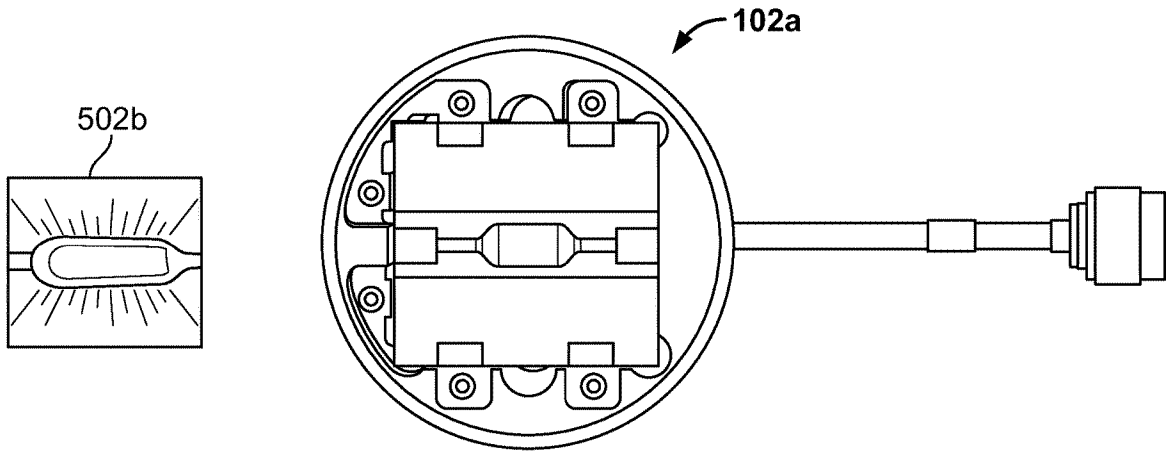

FIG. 4A is a head-on front view of an individual light-emitting device 102*a* incorporated into the apparatus 100 of FIG. 1. FIG. 4B is a side view of the light-emitting devices 102*a* of FIG. 4A. FIG. 4C is a bottom side-view of the light-emitting devices 102*a* of FIG. 4B. FIGS. 5A and 5B show the same views of the light-emitting devices 102*a* of FIGS. 4B and 4C, respectively, with accompanying images 502*a*, 502*b*, respectively, showing plasma emission (through welding glass) of the light-emitting devices 102*a*. In an example, the plurality of light-emitting devices 102*a*-102*n* may be configured to emit one or more wavelengths of ultraviolet light. Suitable examples of the light-emitting devices 102*a*-102*n* include the STA series (STA-25, STA-41, STA-75) of Light Emitting Plasma™ (LEP) radio-frequency powered devices manufactured by Luxim Corporation of Santa Clara, Calif. In an example, each light-emitting device (e.g., 102*a*) of the plurality of light-emitting devices 102*a*-102*n* may comprise a filament-less bulb 402, filled with one or more materials to emit ultra-violet light in response to excitation by radio-frequency or microwave energy. In one example, a material filling at least one filament-less bulb 402 may differ from a material filling another filament-less bulb (not shown) of the plurality of light-emitting devices 102*a*-102*n*.

The light-emitting device 400 may comprise a housing 404 having a top wall 406 and one or more side walls 408 (e.g., a single cylindrical side wall 406). The top wall 406 and the one or more side walls 408 may define an enclosure 410 having an open end 412. A distal side of the filament-less bulb 402 may face outward from the open end 412 of the enclosure 410 and configured to emit light from the open end 412. The open end 412 may be aligned with the open end 112 to emit light outwardly from the housing 104 in the direction 113, 413 focused by the reflectors 118, 122 of FIGS. 1, 2A, and 2B onto a surface of a target (not shown).

In an example, the light-emitting device 400 may comprise a dielectric packing material 414 thermally coupled between the housing 404 and a proximal side 416 of the filament-less bulb 402. In one example, the dielectric packing material 414 may comprise aluminum oxide. A pair of radio-frequency or microwave electrodes 418 may extend from behind the filament-less bulb 402. A radio frequency or microwave cable 422 may be electrically coupled to and extending from the pair of radio-frequency or microwave electrodes 418.

In an example, a dielectric coating (e.g., a multi-layer stack or a quartz-reflective coating (QRC)) may be formed on the backside of the filament-less bulb to enhance reflectivity in the UV portion of the electromagnetic spectrum.

In an example, the housing 404 may be configured to receive an external heat sink (not shown). In an example, the heat sink (not shown) may be an air cooled or liquid cooled heat sink.

Figure 6:
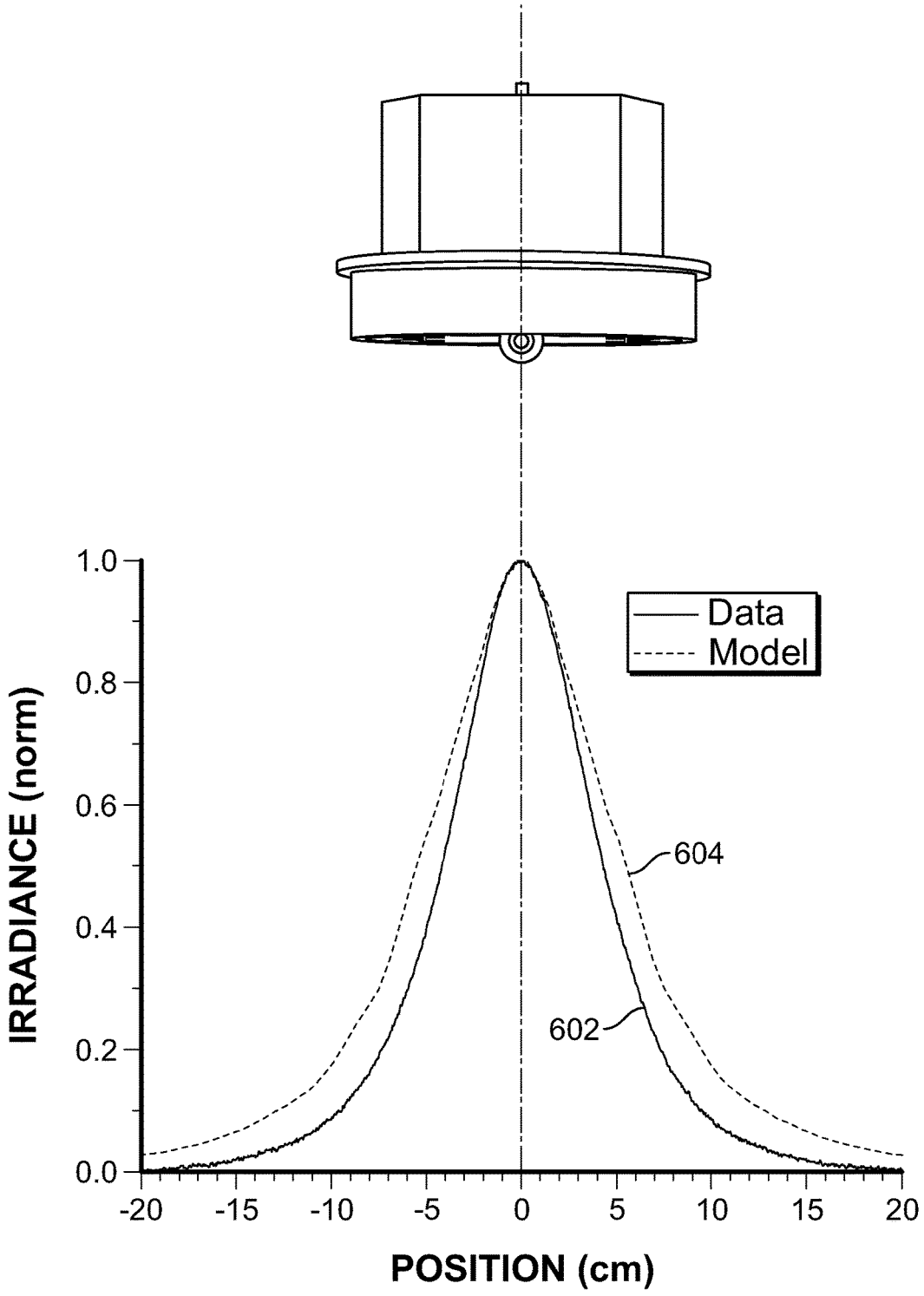
FIG. 6 is a two-dimensional plot of a measured irradiance profile versus a modeled irradiance profile of an example of a light-emitting device of FIGS. 4A-4C.

FIG. 6 is a two-dimensional plot of a measured irradiance profile 602 versus a modeled irradiance profile 604 of an example of a light-emitting device (e.g., 102*a*). Simulations were performed using Photopia optical modeling software and measurements were performed using an industry standard PowerMap® radiometer (manufactured by EIT, LLC of Sterling, Va.). Intensity scales were normalized to closely compare spatial distribution of light. The distance to a target was set to about 77 mm. The dotted line 606 shows the bulb center line and alignment with the data. As illustrated by the data, the modeled irradiance profile 604 and measured irradiance profile 602 are extremely close in spatial extent.

The present invention has advantages of flexibility and efficiency. An array of small (1" long) UV light-emitting devices 102*a*-102*n* may provide a nearly constant irradiance of light over a large area by the use of an emitter arrangement and simple external optics. By using many small UV light-emitting devices 102*a*-102*n*, the location of the individual light-emitting devices 102*a*-102*n* is flexible (independent) with respect to each other. This permits finer control of a resultant (light) irradiance pattern. Also, if desired, individual bulb fills can be varied to produce a more customized spectral content in the irradiance pattern. Efficiency (total percentage of emitted light striking surface) may be well above 80% with less than 5% uniformity fluctuations, whereas present day designs operate at 50% efficiency and greater than 7% uniformity fluctuations.

Examples of the present disclosure may be applied to numerous areas, such as semiconductor processing of films, flat panel display fabrication, and wide-web applications.

It is to be understood that the above description is intended to be illustrative, and not restrictive. Many other embodiments will be apparent to those of skill in the art upon reading and understanding the above description. Although the present disclosure has been described with reference to specific exemplary embodiments, it will be recognized that the disclosure is not limited to the embodiments described, but can be practiced with modification and alteration within the spirit and scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

What is claimed is:

1. An apparatus, comprising:

a first housing having a top wall and one or more side walls, the top wall and the one or more side walls defining a first enclosure having a first open end;

a plurality of filament-less bulbs arranged within the first enclosure of the first housing, one side of each of the plurality of filament-less bulbs facing outward from the first open end of the first enclosure, the plurality of filament-less bulbs configured to emit light from the first open end to produce a substantially uniform area of illumination on a facing portion of a surface of a target, a first reflector extending from the one or more side walls proximal to the open end of the first housing; and a second reflector extending from the first reflector, the second reflector being separated from the first reflector by a vacuum interface window.

2. The apparatus of claim 1, wherein a location of an individual filament-less bulbs relative to other filament-less bulbs of the plurality of filament-less bulbs is variable.

3. The apparatus of claim 1, wherein a first location of an individual filament-less bulb is independent of a second location of other filament-less bulbs of the plurality of filament-less bulbs.

4. The apparatus of claim 1, wherein the plurality of filament-less bulbs is arranged within the first housing with a higher density of filament-less bulbs proximal to the one or more side walls of the first housing relative to the center of the first housing.

5. The apparatus of claim 1, wherein the plurality of filament-less bulbs is configured to emit one or more wavelengths of ultraviolet light.

6. The apparatus of claim 1, wherein each filament-less bulb is filled with one or more materials to emit ultra-violet light in response to excitation by radio-frequency or microwave energy.

7. The apparatus of claim 1, wherein a material filling a first filament-less bulb of the plurality of filament-less bulbs differs from a material filling a second filament-less bulb of the plurality of filament-less bulbs.

8. The apparatus of claim 1, wherein a first filament-less bulb of the plurality of filament-less bulbs comprises:

a second housing having a second top wall and one or more second side walls, the second top wall and the one or more side walls defining a second enclosure having a second open end, a distal side of the first filament-less bulb facing outward from the second open end of the second enclosure and configured to emit light from the second open end.

9. The apparatus of claim 8, wherein a first filament-less bulb further comprises:

a dielectric packing material thermally coupled between the second housing and a proximal side of the first filament-less bulb;

a dielectric coating formed on the backside of the first filament-less bulb;

a pair of radio-frequency or microwave electrodes extending from behind the first filament-less bulb; and a radio frequency or microwave cable electrically coupled and extending from the pair of radio-frequency or microwave electrodes.

10. The apparatus of claim 8, wherein the second housing is configured to receive an air or water cooled external heat sink.

11. The apparatus of claim 1, wherein a reflective coating is included on an inner surface of the first reflector.

12. The apparatus of claim 11, wherein the first reflector is made from one of metal or a quartz-based material.

13. The apparatus of claim 12, wherein the quartz-based material has at least one of a high specular reflection dielectric coating or a diffuse quartz reflecting coating.

14. The apparatus of claim 11, wherein the second reflector has the same shape as the first reflector.

15. The apparatus of claim 14, wherein the second reflector is made from one of metal or a quartz-based material.

16. The apparatus of claim 15, wherein the quartz-based material has at least one of a high specular reflection dielectric coating or a diffuse quartz reflecting coating.

17. The apparatus of claim 14, further comprising a metal screen proximal the vacuum interface window.

18. The apparatus of claim 17, wherein the vacuum interface window comprises quartz.

19. The apparatus of claim 17, wherein the vacuum interface window comprises an anti-reflective coating on at least one surface.

20. The apparatus of claim 17, wherein the vacuum interface window, the first reflector, and the housing form a second enclosure, the second enclosure evacuated of air to form a vacuum enclosure.

* * * * *